United States Patent [19]

Schaming

[11] 4,252,572

[45] Feb. 24, 1981

[54] APPARATUS FOR CLEANING A METAL STRIP IN A ROLLING MILL

[76] Inventor: Edward J. Schaming, P.O. Box 1070, Butler, Pa. 16001

[21] Appl. No.: 73,430

[22] Filed: Sep. 7, 1979

Related U.S. Application Data

[62] Division of Ser. No. 003,362, Jan. 15, 1979.

[51] Int. Cl.[3] ..... B08B 3/02

[52] U.S. Cl. ..... 134/57 R; 134/102; 134/122 R; 134/199; 239/138; 266/113; 417/168

[58] Field of Search ..... 134/15, 36, 64 R, 122 R, 134/100, 102, 57 R, 199; 266/113; 239/307, 310, 138, 428; 417/165, 168

[56] References Cited

U.S. PATENT DOCUMENTS

| | | | |
|---|---|---|---|
| 2,056,240 | 10/1936 | Wheeler | 417/165 |
| 2,234,153 | 3/1941 | Herbert | 134/15 X |
| 3,276,694 | 10/1966 | Alexander | 134/102 X |
| 3,543,775 | 12/1970 | Bodnar | 135/15 X |
| 3,554,513 | 1/1971 | Chance | 266/113 |
| 3,829,024 | 8/1974 | Heden | 134/100 X |

FOREIGN PATENT DOCUMENTS

| | | | |
|---|---|---|---|
| 1403149 | 11/1968 | Fed. Rep. of Germany | 134/102 |
| 1171311 | 11/1969 | United Kingdom | 134/57 R |

*Primary Examiner*—Robert L. Bleutge
*Attorney, Agent, or Firm*—D. Paul Weaver

[57] ABSTRACT

Ambient water and steam in a predetermined ratio are delivered into the entrance of a venturi chamber in a fluid accelerator. The steam condenses and in so doing elevates the water temperature significantly. The heated water passes through a venturi throat and then has its pressure elevated considerably above the pressure of the incoming steam prior to discharging from the accelerator into valved piping leading to cleaning spray headers on opposite sides of the moving metal strip. High pressure, high temperature water cleaning sprays are directed through header nozzles onto the strip to thoroughly clean its entire surfaces. Venturi vacuum is utilized whenever desired to draw a cleaning additive into the system where such additive is entrained in the water stream. Simplicity and economy are achieved in a highly efficient cleaning system.

6 Claims, 5 Drawing Figures

APPARATUS FOR CLEANING A METAL STRIP IN A ROLLING MILL

This is a division of application Ser. No. 003,362, filed Jan. 15, 1979.

BACKGROUND OF THE INVENTION

Traditionally, metal strip stock such as steel or aluminum in rolling mills is cleaned by systems which vary in complexity, cost and effectiveness. In many installations, motor driven cleaning brushes are mounted above and below the moving strip stock and sprays of water, or water containing additives, are directed onto the strip while the power brushes do their work. Such prior art systems also involve liquid pumps and heaters and tend to be very costly to operate and maintain and also consume large amounts of energy and water. Cleaning systems employing brushes have also proven to be relatively inefficient for cleaning strips which travel at comparatively high speeds common in modern mills.

The present invention has been developed to overcome the above drawbacks of the known prior art while providing an even more efficient and thorough cleaning of the product with greater economy, less requirement for expensive maintenance, and a substantial savings of energy.

The method embodying the invention eliminates entirely the necessity for motor operated brushes and attendant heavy and costly equipment. In essence, the invention comprises an intermixing of ambient water and steam at the entrance of a venturi chamber where the steam condenses and elevates the temperature of the water. The water accelerates through the throat of the venturi chamber and on exiting this throat expands into a venturi exit chamber of enlarged cross section where the pressure of the heated water is increased substantially above incoming steam pressure. The water having elevated pressure and temperature is delivered through piping to two or more spray cleaning headers on opposite sides of the moving strip where multiple opposing sprays are directed onto opposite sides of the strip. The optional cleaning additive can be drawn by vacuum into the entrance chamber of the venturi whenever needed by the mere operation of a metering valve. The invention can operate in a manual mode or an automatic mode depending upon the requirements of particular installations and the degree of convenience and sophistication desired.

Other aspects of the invention will become apparent during the course of the following detailed description.

The below-listed prior U.S. Pat. Nos. are noted herein under 37 C.F.R. 1.56:

2,319,591
2,391,422
2,508,766
2,592,884
2,861,838
2,943,797
3,380,658
3,438,583
3,473,481
3,510,065
3,810,787
3,873,024
4,029,260.

DETAILED DESCRIPTION

Figure 1:
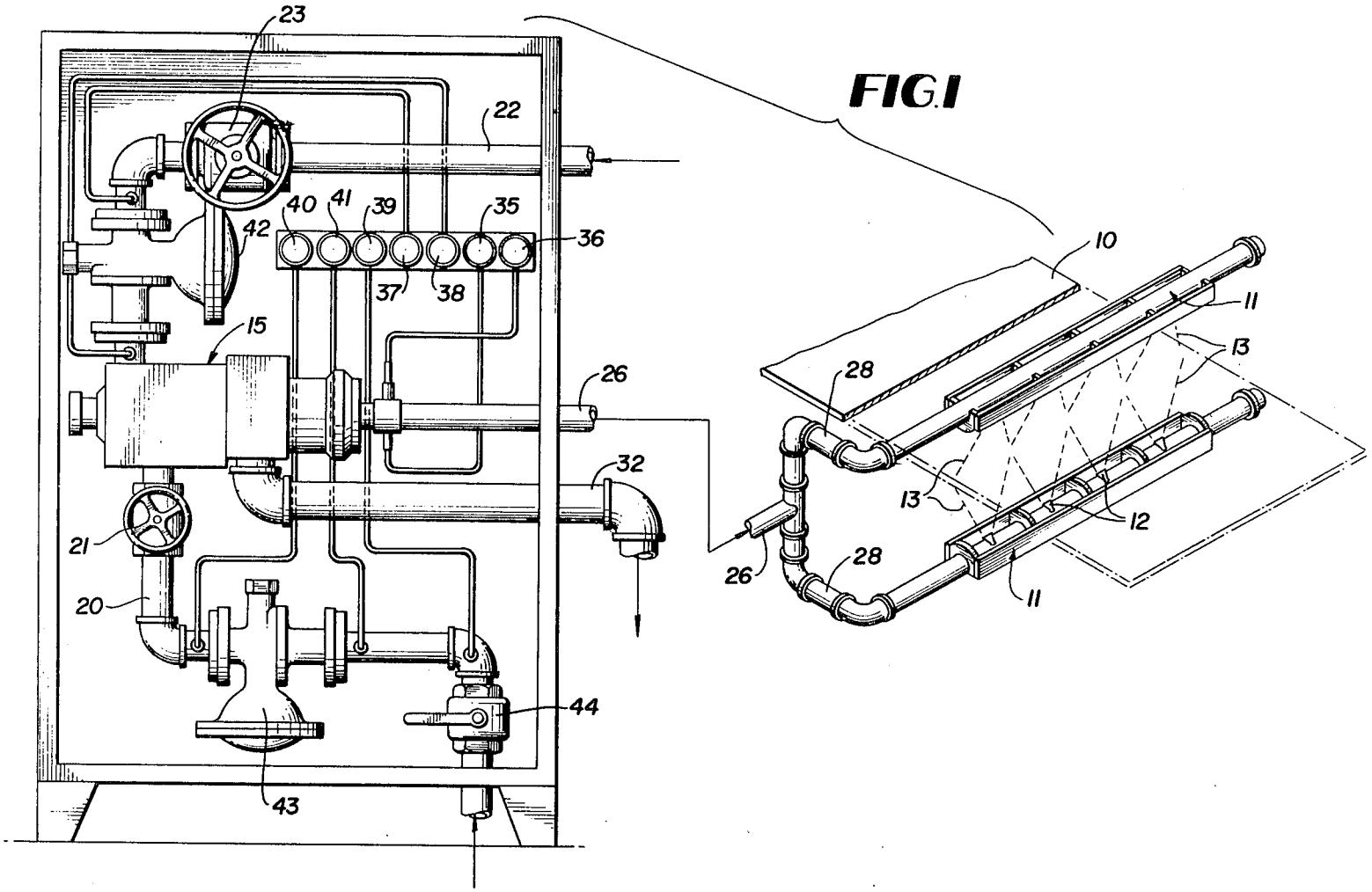
FIG. 1 is a pictorial view, partly in perspective and partly in elevation, of apparatus embodied in the invention.

Referring to the drawings in detail wherein like numerals designate like parts, a moving metal strip 10 which has been exposed to oil, acids, dirt and grime in a metal rolling mill requires the thorough cleaning of its opposite surfaces prior to further conventional treatment. The present invention provides a complete, self-contained and efficient cleaning system directly in the process line to satisfy the cleaning requirements including the removal of dirt which has become entrenched in the surfaces of the metal strip. As will be fully described, the cleaning process embodying the invention involves directing multiple high pressure and high temperature water sprays with or without a cleaning additive such as a detergent onto the opposite surfaces of the moving strip 10 which can be traveling at speeds approaching fifty miles per hour in a rolling mill.

To effect the necessary cleaning of the strip 10, one or more cleaning spray headers 11 are fixedly mounted on opposite sides of the strip 10 in equidistantly spaced relationship from the strip. In practice, each header 11 can be spaced approximately one foot from the strip. As many pairs of headers 11 may be employed as required to meet the requirements of a given installation. In the drawings, a single pair of headers 11 are shown for the sake of simplicity of illustration.

Figure 4:
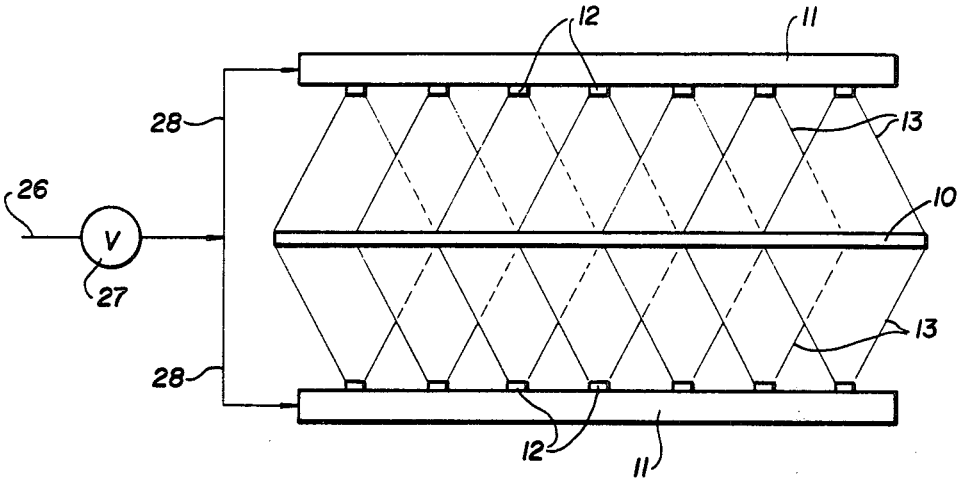
FIG. 4 is a partly schematic elevational view of cleaning spray headers and showing cleaning spray patterns.

Each header 11 carries a plurality of equidistantly spaced nozzles 12 which direct constant and equal force high pressure, high temperature sprays 13 onto both sides of the moving strip 10 across the full width thereof. The multiple sprays 13, as best shown in FIG. 4, are arranged in overlapping or "shingled" non-interfering relationship to assure complete and efficient cleansing of both surfaces of the strip 10 with no gaps in the spray patterns.

Figure 2:
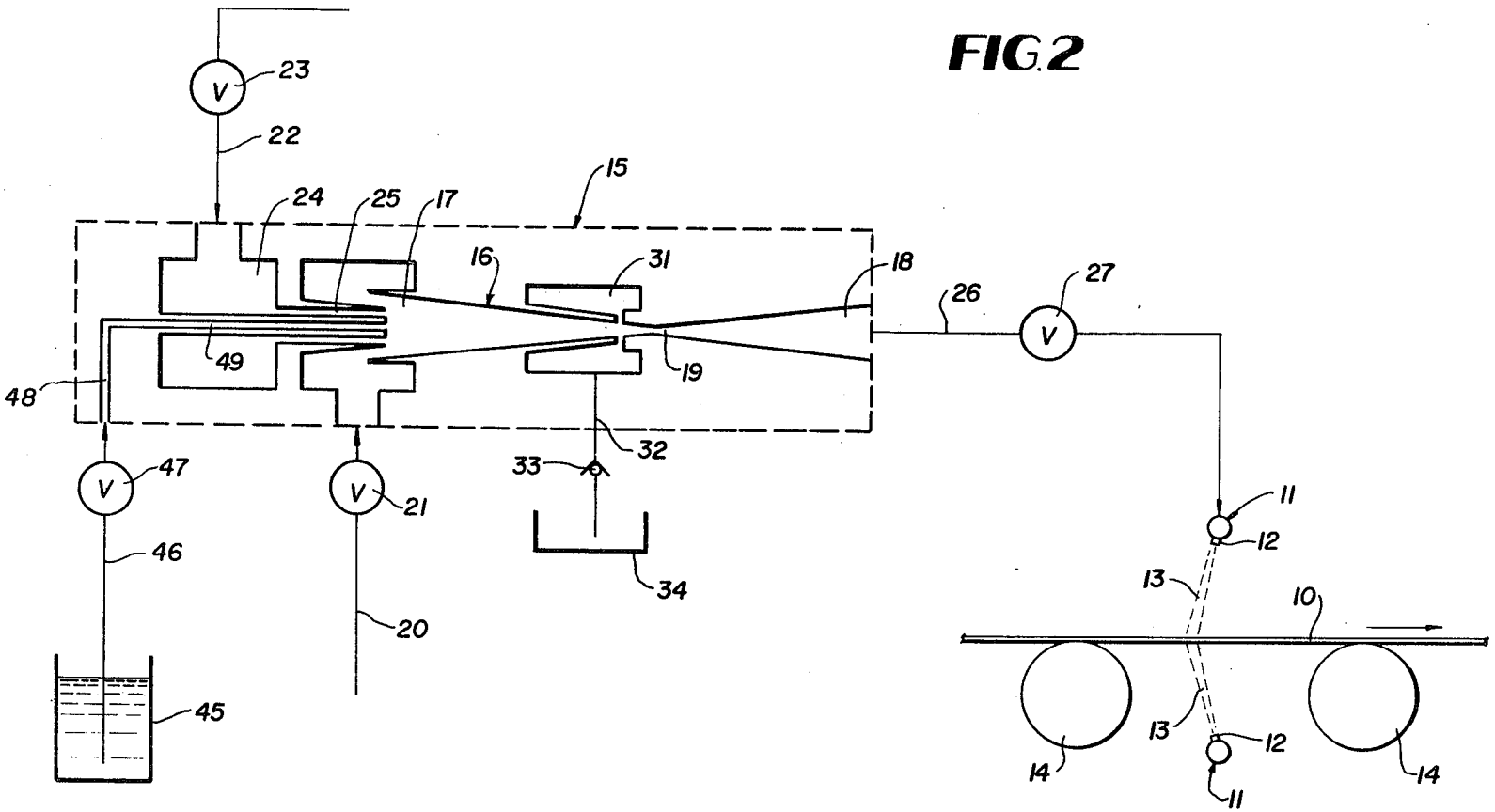
FIG. 2 is a partly diagrammatic side elevational view of the invention as embodied in a manually controlled system including details of a fluid accelerator.
Figure 3:
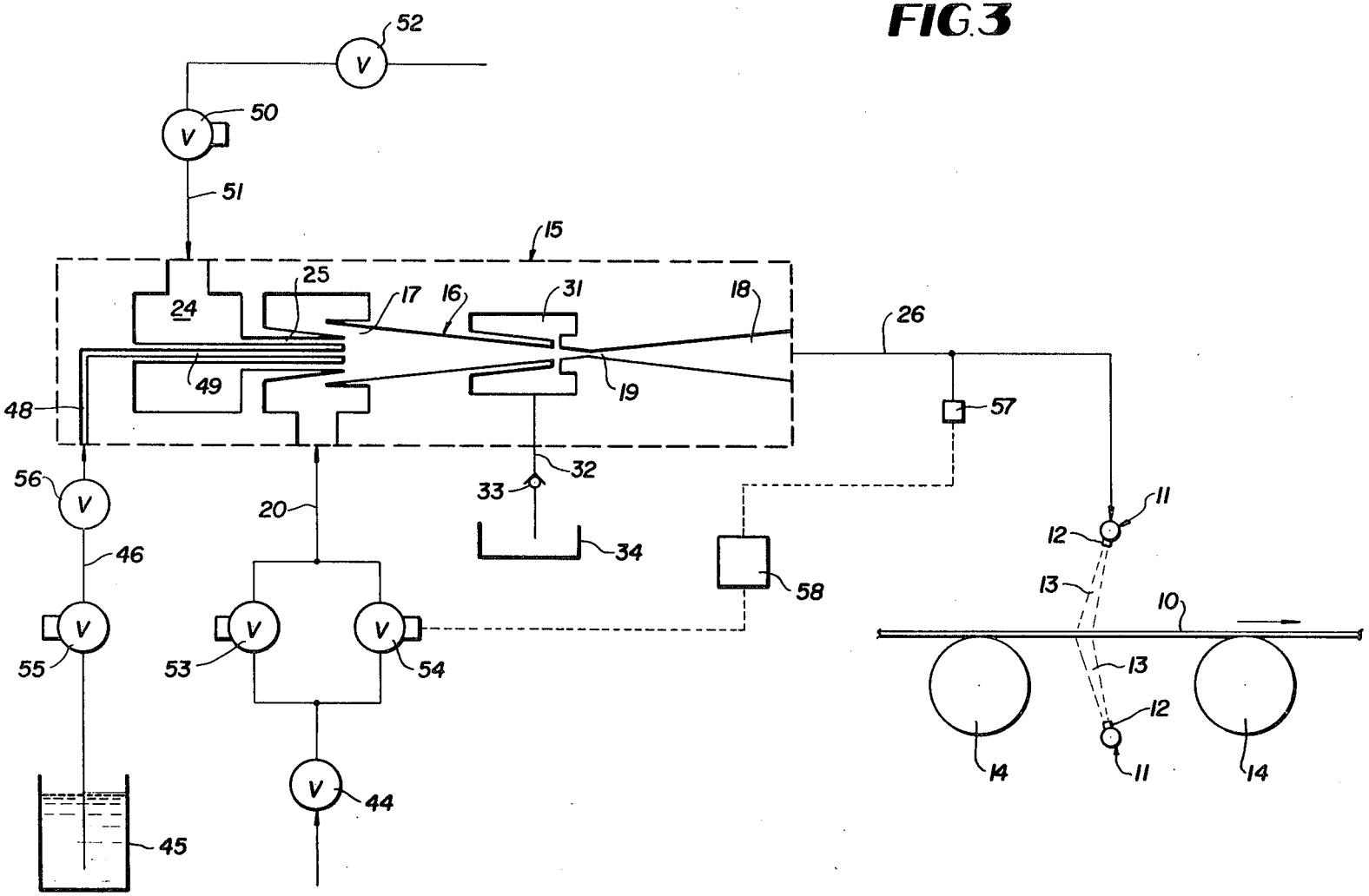
FIG. 3 is a similar view of the invention as embodied in an automatically controlled system.

As shown in FIGS. 2 and 3, the nozzles 12 are preferably angled so that the sprays 13 converge and meet somewhat upstream from the headers 11, in relation to the path of movement of the metal strip 10 which is supported on rollers 14 in the processing line.

The invention is embodied in a manually controlled system, FIGS. 1 and 2, or in an automatic system, FIG. 3. The manual system will be first described for convenience.

The heart of the invention resides in a fluid accelerator unit 15 having a venturi chamber 16 including an entrance chamber 17, an exit or discharge chamber 18, and a restricted venturi throat 19. Ambient water at a preferred temperature below 90 degrees F. and a pressure of about 50 psi is delivered to the accelerator unit through a water supply pipe 20 having a manual control valve 21 external to the unit 15. The ambient water from the pipe 20 is delivered directly into the enlarged venturi entrance chamber 17. Simultaneously, steam from any suitable steam generating source, not shown, is delivered through a steam supply pipe 22 having a manual control valve 23 directly into an enlarged chamber 24 of the accelerator unit 15. The incoming steam is at an ideal pressure of about 150 psi but the pressure may vary in practice over a fairly wide range between about 60 psi and 400 psi.

The steam chamber 24 communicates with the venturi entrance chamber 17 through an annular passage 25 which does not restrict the flow of steam. The incoming steam and ambient water meet and comingle in the venturi entrance chamber 17 where the steam immediately condenses giving up heat, as a result of which the temperature of the water is elevated by at least approximately 100 degrees F. over ambient water temperature.

The resulting high temperature water in a continuous flow process passes through the narrow venturi throat 19 and in so doing has its velocity increased and its pressure momentarily decreased, following which the water enters the enlarged venturi exit chamber 18 where its pressure is significantly increased to the extent of two to two and one-half times inlet steam pressure delivered through the pipe 22. The high pressure, high temperature water in the venturi exit chamber 18 now passes into a discharge pipe 26 having a manual flow control valve 27 connected therein. The pipe 26 leads to and is connected with branch water pipes 28, FIG. 1, which lead to and supply the headers 11 with water at an elevated pressure and temperature which is adjustable in the system but preferably constant at any chosen degree of adjustment.

The temperature of the incoming ambient water through supply pipe 20 has only a limited influence on system efficiency in that higher water temperature diminishes the amount of steam that will be condensed in the accelerator unit 15 and still produce the required high pressure, high temperature water discharge from the exit chamber 18.

The manual valves 21 and 23 are adjusted to establish the volumes of water and steam necessary to create the proper balance and water pressure and temperature increase in the accelerator unit. Generally speaking, the ratio of one pound of steam entering the accelerator unit per gallon of hot water discharged through the pipe 26 prevails. However, the exact ratio depends upon whether the incoming steam is near the high or low limits of acceptable steam pressure noted above, namely sixty to about four hundred psi.

Figure 5:
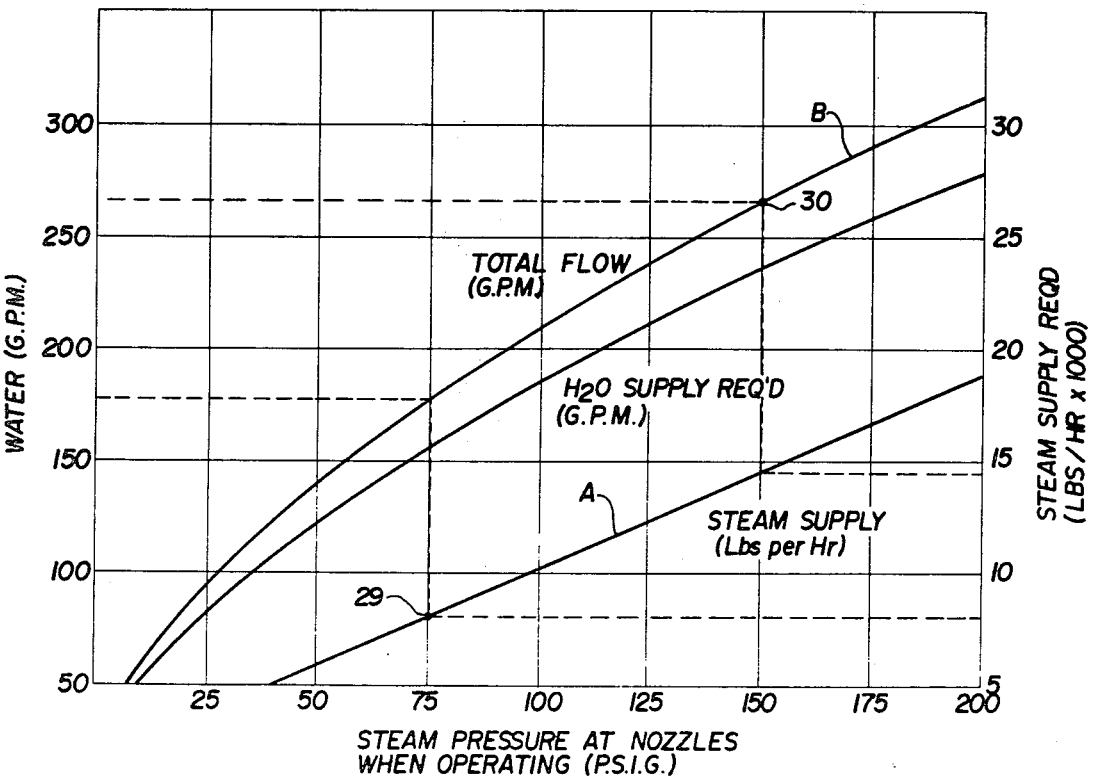
FIG. 5 is a chart depicting the relationships between steam pressure, steam supply and water flow.

The chart depicted in FIG. 5 is intended to clarify the actual ratio of incoming steam pressure in psi to water discharged from the accelerator in gallons per minute and steam supply required in thousands of pounds per hour. It can be observed in the chart at the point 29 on the steam supply curve A that where incoming steam pressure is near the low pressure acceptable limit the ratio between total water discharge flow in gallons per minute and steam supply required is considerably greater than one-to-one and is, for example, approximately ten thousand eight hundred gpm to about eight thousand pounds per hour of supplied steam.

In contrast to this ratio, at the point 30 on curve B where steam pressure is at or near the ideal 150 psi, the ratio of total flow of water to steam supply is much more nearly one to one, and, for example, at the point 30 is approximately 15,900 gpm to 14,500 pounds per hour.

The accelerator unit 15 is equipped with a safety bypass arrangement which becomes operative in the event that a large number of the spray nozzles 12 become plugged to create a dangerous back pressure. The safety bypass arrangement includes a chamber 31 in communication with the venturi chamber near its throat and connected to a safety bypass line 32 having a one-way opening check valve 33 therein which opens automatically when a predetermined safe water pressure is exceeded. The bypass line 32 beyond the check valve 33 leads to an overflow drain or reservoir 34.

As depicted in FIG. 1, the system is preferably equipped with conventional hot water pressure and temperature gages 35 and 36, steam pressure gages 37 and 38 for unregulated and regulated steam, a cold water temperature gage 39, and cold water pressure gages 40 and 41 for regulated and unregulated incoming ambient water. Conventional steam and water pressure regulators are included in the system at 42 and 43 along with a main water shut off valve 44 in the incoming water line.

It should be mentioned that the flow of water into the accelerator unit must always be sufficient to satisfy the flow requirements at the throat 19 of the venturi chamber with no voids in the fluid flowing through the venturi chamber. The water flow into the accelerator must also be in the proper volume to fully condense the incoming steam if the desired increases in water pressure and temperature are to be achieved in the system. Therefore, the valves 21 and 23 require some monitoring and adjustment in the manual system. The number and location of the headers 11 and the number and aperture sizes of the nozzles 12 will vary somewhat to meet the requirements of particular installations. Design calculations or engineering calculations can easily be made to satisfy these varying parameters.

Ideally, the high pressure, high temperature water being discharged at the nozzles 12 is at a temperature of about 180 degrees F. and a pressure 250–300 psi.

When a given installation requires the use of a cleaning additive, such as a detergent, such an additive held within a reservoir 45 external to the accelerator unit 15 can be introduced in the required quantity through a line 46 having a metering valve 47 therein. The additive supply line 46 is coupled to a port 48 of the accelerator unit which leads to a longitudinal passage 49 interiorly of the annular steam passage 25. By this means, the additive such as a detergent discharges directly into the venturi entrance chamber 17 along with the steam and water, and is effectively entrained in the resulting high pressure, high temperature water stream delivered through the exit chamber 18 to the spray header of supply pipe 26.

Referring to FIG. 3, the invention can be embodied in an automatic cleaning system which eliminates the need for close manual control. The end results obtained by the manual and automatic systems are identical. The use of the automatic system will be dictated by factors of economics and desired convenience.

In the automatic system, an automatic steam pressure adjustment valve 50 is inserted in the steam inlet pipe 51 downstream from a manual shut off valve 52, and upstream from the described chamber 24 of the accelerator unit 15. Similarly, an automatic water pressure adjustment valve 53 is located in the ambient water supply line or pipe 20 upstream of the main water shut off valve 44 shown in FIG. 1. The automatic valve 53 is connected in parallel flow relationship with another automatic valve 54. The two automatic valves 50 and 53 and a third such valve 55 connected in the additive supply line 46 are conventional devices manufactured by Hill McCanna, 400 Maple Ave., Carpentersville, Ill. 60110, under No. F602-CS-F-56/SP8A (Ball Valve with Air Actuator). The valve 54 is a Series 70 Jordan valve, manufactured by Jordan Valve of Cincinnati, Ohio 45216, or an equivalent device.

A manual metering valve 56 is also included in the additive supply line 46. A water temperature sensor 57 of a conventional type is connected in the spray header supply pipe 26, and a signal from this sensor is fed to a temperature-pressure transmitter 58, such as a Model 40 Temperature Control by AMETEK, Sellersville, Pa. 18960, or an equivalent device. The transmitter 58, in turn, relays a relative air pressure signal to the automatic control valve 54, which in turn resets the control portion of the automatic water flow adjustment so as to maintain the required balance of incoming water and high pressure, high temperature water discharging from the nozzles 12.

As with the manual system of FIG. 2, the metering valve 56 regulates the amount or volume of additive permitted to be drawn into the venturi chamber 16 when an additive is needed. The automatic valve 55 opens and closes automatically in response to demand for additive after the metering valve 56 has been set to control the amount of additive. In both the manual and automatic modes, the partial vacuum created in the entrance venturi chamber 17 sucks or draws the additive into the system once the metering valve 56 is adjusted to the desired degree of opening. In the automatic system, the valve 55 will open in response to suction in the chamber 17.

It is thought that the advantages of the invention over the known prior art, particularly, in terms of simplicity and economy, will now be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. Apparatus for cleaning a metal strip moving at high speed along a process line comprising at least one pair of spray headers mounted on opposite sides of said moving strip for directing high temperature and high pressure streams of water against opposite sides of the strip entirely across the strip, adjustable means for delivering controlled high temperature and high pressure water in a continuous stream and substantially constant volume to said headers, said adjustable means comprising a fluid accelerator having a venturi chamber therein, adjustable valve means for continually delivering regulated quantities of ambient water and steam to an inlet part of said venturi chamber, said adjustable valve means being automatically operable and including a pair of automatic valves connected in parallel flow relationship within an ambient water delivery line leading to said venturi chamber, a water temperature sensor connected in a high temperature-high pressure water delivery pipe leading from said venturi chamber and toward said spray headers, and a temperature-pressure transmitter device coupled between said sensor and one of said parallel connected automatic valves.

2. The apparatus of claim 1, and another automatic valve connected in a steam delivery line leading to said venturi chamber.

3. The apparatus of claim 2, and said venturi chamber having an enlarged entrance portion, an intermediate throat and an enlarged discharge portion, said enlarged discharge portion coupled with said water delivery pipe, said enlarged entrance portion being coupled with said ambient water delivery line.

4. Apparatus for cleaning a metal strip moving at high speed along a process line comprising at least one pair of spray headers mounted on opposite sides of said moving strip for directing high temperature and high pressure streams of water against opposite sides of the strip entirely across the strip, adjustable means for delivering controlled high temperature and high pressure water in a continuous stream and substantially constant volume to said headers, said adjustable means comprising a fluid accelerator having a venturi chamber therein, adjustable valve means for continually delivering regulated quantities of ambient water and steam to an inlet part of said venturi chamber, said adjustable valve means comprising a steam inlet valve and an ambient water inlet valve coupled respectively with a steam chamber of said fluid accelerator upstream from the inlet part of the venturi chamber and with the inlet part of the venturi chamber, and an additional adjustable valve means coupled between the venturi chamber of said fluid accelerator and said spray headers.

5. Apparatus for cleaning a metal strip moving at high speed along a process line as defined in claim 4, and additional adjustable valve means connected in said fluid accelerator in communication with the inlet part of said venturi chamber to deliver a cleaning additive thereto in response to suction in said inlet part.

6. Apparatus for cleaning a metal strip moving at high speed along a process line as defined in claim 5, and said last-named adjustable valve means communicating with said inlet part of the venturi chamber through a passage which is coaxial with the venturi chamber and coaxial with a surrounding passage extending from said steam chamber into said inlet part of the venturi chamber.

* * * * *